United States Patent [19]

Plummer

[11] 4,150,733

[45] Apr. 24, 1979

[54] SPORTSMAN'S SEAT

[76] Inventor: Mace E. Plummer, Rte. 2, Box 39, Siren, Wis. 54872

[21] Appl. No.: 865,524

[22] Filed: Dec. 29, 1977

[51] Int. Cl.[2] ..... A45F 3/26

[52] U.S. Cl. ..... 182/187; 182/20; 108/121; 248/168

[58] Field of Search ..... 182/187, 188, 20, 33, 182/28, 35; 248/168; 108/152, 121, 132, 127

[56] References Cited

U.S. PATENT DOCUMENTS

| | | | |
|---|---|---|---|
| 1,205,057 | 11/1916 | Sulenski | 248/168 |
| 1,240,119 | 9/1917 | Burns | 248/168 |
| 3,261,425 | 7/1966 | Harder | 182/187 |
| 3,396,818 | 8/1968 | Moragne | 182/187 |
| 3,927,733 | 12/1975 | Wurn | 182/187 |
| 3,990,537 | 11/1976 | Swenson | 182/187 |

*Primary Examiner*—Reinaldo P. Machado
*Attorney, Agent, or Firm*—Howard I. Podell

[57] ABSTRACT

A foldable assembly comprising a seat rotatably mounted on a support to which are collapsibly mounted three legs. One of the legs can be secured to a tree. Foothold means are provided on one of the legs. Means are provided also to adjust the length of the legs.

3 Claims, 6 Drawing Figures

SPORTSMAN'S SEAT

FIELD OF THE INVENTION

This invention relates to a foldably, portable seat for use by sportsmen as a hunting seat or tree seat and the like.

THE PRIOR ART

The prior art is generally illustrative of various devices of this type. While such devices are generally acceptable for their intended purpose they have not proven to be entirely satisfactory in that they are either complex and expensive to manufacture, or bulky and inconvenient to use, or require unusual skill and/or dexterity to operate. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

The principal object of this invention is to provide an article of this character which combines simplicity, strength and durability in a high degree, together with inexpensiveness of construction.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

BRIEF DESCRIPTION OF THE DRAWINGS

In the accompanying drawing, in which is shown one of the various possible illustrative embodiments of this invention, wherein like reference character identify the same or like parts.

DESCRIPTION OF THE PREFERRED EMBODIMENT

Figure 1:
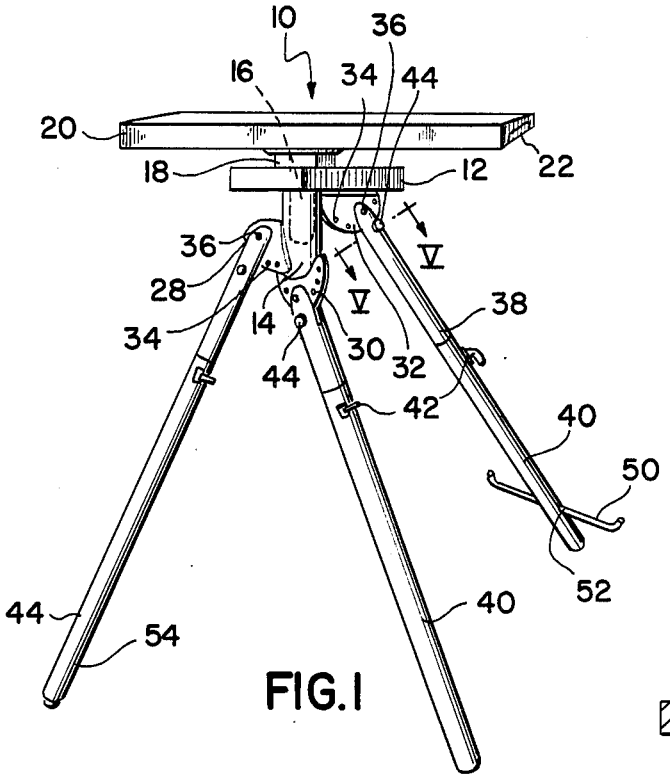
FIG. 1 is a perspective view of the seat of the invention shown in use position.

With reference to the drawing, there is shown and illustrated a PORTABLE, FOLDABLE SEAT constructed in accordance with the principles of the invention and designated generally by reference character 10.

The seat 10 includes a supporting frame 12 having integral therewith or secured thereto as by screws or welding a tubular sleeve 16 with an open upper end in which is rotatably and removably received shaft 23 depending from nut bearing 18 on whose upper surface is secured seat 20. This seat 20 comprises a ½ inch plywood board 22 covered with foam 24. Seat 20 rotates through 360 degrees with relation to frame 12.

Sleeve 16 of frame 12 is rotatably mounted in an axial recess of housing 14 allowing housing 14 to rotate through 360 degrees with relation to frame 12.

Set screw 26 in housing 14, when tightened against sleeve 16 tightens sleeve 16 about shaft 23 to lock all engaged members in non-rotational engagement.

Secured on housing 14 are a pair of semicircular pivot members one 28 mounted at one side and the other 30 at the bottom thereof. Secured to the bottom of member 12 is a similar pivot member 32. Each pivot member has a plurality of openings 34 spaced about its outer periphery. Three legs are pivoted from their upper ends to the pivots by pins 36.

Each pivot member 28, 30 and 32 is in the form of a flat circular-shaped flat plate, with the plane of pivot members 28 and 30 set at an angle of 120 degrees about the axis of sleeve 14.

Each leg includes an upper section 38 terminating in a lower section of reduced diameter (not shown) slidably received in tubular lower section 40 of the same diameter as the upper section and having clamps 42 engaging the lower sections to lock them in place.

Figure 5:
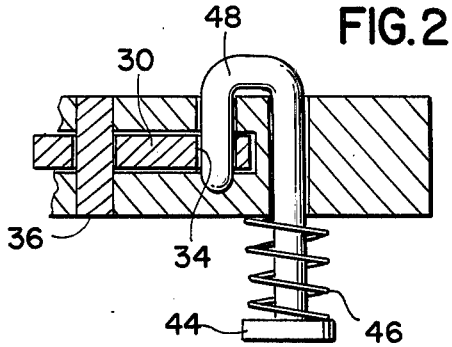
FIG. 5 is a section through line V—V of FIG. 1 showing the leg release mechanism for the legs.

A leg set button assembly 44 including a spring 46 urging hook 48 into one of the openings 34 and push button 48 is provided for each leg as shown in FIG. 5.

On one of the legs a foot rest 50 is provided and passed through an opening 52 therein as shown in FIG. 1. It is used when the seat is used as a tree seat or used on soft ground in other instances. Foot rest 50 is inserted into the center of the leg and held by a catch (not shown).

Figure 3:
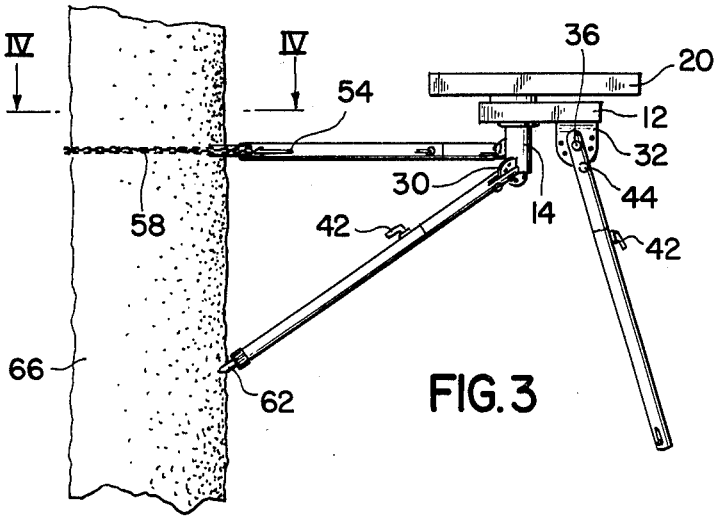
FIG. 3 is an elevational view showing the assembly of the invention used as a tree seat.
Figure 4:
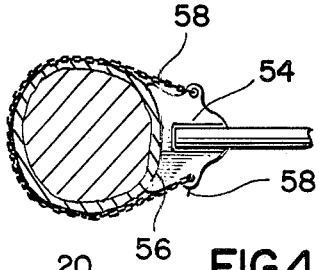
FIG. 4 is a section through line IV—IV of FIG. 3.
Figure 6:
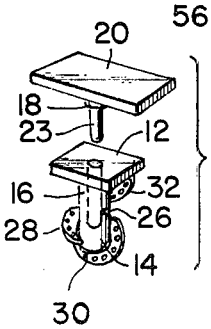
FIG. 6 is an exploded detail perspective view of the assembly.

When the assembly is to be used as a tree seat; a tree clamp 54 is provided at the end of one of the legs, integral therewith or pivoted, or removably secured thereto. The clamp has a generally arcuate truck-engaging portion 56 (FIG. 4). A chain 38 at one end and a hook 58 at the other for securing a link of the chain after passing the chain around the trunk of tree 60 (FIG. 3). A hook 62 is provided at the end of the adjacent leg for engaging the trunk to further stabilize the assembly.

Figure 2:
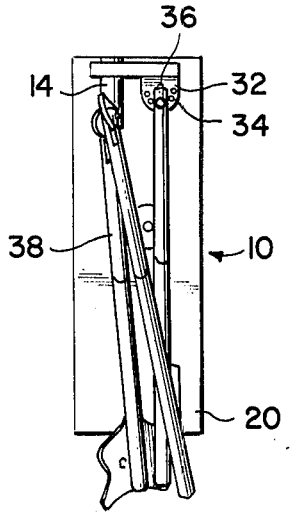
FIG. 2 is an elevational view of the same in collapsed position.

As shown in FIG. 2, the assembly is collapsible with the legs folding on the seat around the axis of shaft 16.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size and arrangement of the elements of this invention as claimed may be resorted to in actual practice, if desired.

Having thus described the invention, what is claimed as new and to be secured by Letters Patent is:

1. A sportsman's seat assembly comprising, in combination, a supporting frame, a seat rotatably mounted thereon; pivots depending from said frame; telescopic legs mounted thereof; locking means for fixing said legs at a desired angular position relative to said frame; a footrest removably mounted at the end of one of said legs; a tree engaging clamp mounted at the end of another of said legs and means for securing said clamp about a tree trunk.

2. The invention as defined in claim 1, wherein said means for locking said legs include openings along the outer periphery of said pivots and cooperating engaging means on said legs.

3. The invention as recited in claim 1 including clamp means on said legs.

* * * * *